US008142296B2

(12) United States Patent
Larsen

(10) Patent No.: US 8,142,296 B2
(45) Date of Patent: Mar. 27, 2012

(54) MANEUVERABLE ENTERTAINMENT AND TRAINING SYSTEM

(76) Inventor: Stanley S. Larsen, Seattle, WA (US)

( * ) Notice: Subject to any disclaimer, the term of this patent is extended or adjusted under 35 U.S.C. 154(b) by 396 days.

(21) Appl. No.: 11/900,643

(22) Filed: Sep. 11, 2007

(65) Prior Publication Data

US 2008/0064514 A1 Mar. 13, 2008

Related U.S. Application Data

(60) Provisional application No. 60/825,225, filed on Sep. 11, 2006.

(51) Int. Cl.
*A63C 19/00* (2006.01)

(52) U.S. Cl. ..... 472/94; 472/92

(58) Field of Classification Search ..... 472/94, 472/47

See application file for complete search history.

(56) References Cited

U.S. PATENT DOCUMENTS 3,974,577 A 8/1976 Brachlianoff
4,541,814 A 9/1985 Martin
4,729,446 A 3/1988 Sefton
5,725,435 A * 3/1998 De Castro Faria ..... 472/47
5,803,816 A * 9/1998 Moser et al. ..... 472/46
5,860,811 A 1/1999 Henderson
6,176,584 B1 1/2001 Best et al.
6,563,489 B1 5/2003 Latypov et al.
6,740,009 B1 * 5/2004 Hall ..... 482/54
7,104,222 B2 9/2006 Tsengas

OTHER PUBLICATIONS http://web.archive.org/web/20060105224759/www.globeofdeath.com/index.htm2/23/2010 11:56:26 AM, "Globe of Death", published Feb. 18, 2006.*

* cited by examiner

*Primary Examiner* — Gene Kim
*Assistant Examiner* — Michael Dennis
(74) *Attorney, Agent, or Firm* — Seed IP Law Group PLLC

(57) ABSTRACT

A gravity sports system including a shell that can be rotated and tilted to provide a rider within the shell a variety of challenges. The shell can be formed by rotating a curve, a simple curve, a complex curve, or even a complete curve about an axis of revolution. The internal surface of the shell is sufficiently smooth and large enough to permit a rider to use a variety of wheeled or surface-bearing equipment within the shell. The shell can be rotationally attached to a moveable frame. The frame can be driven to tilt the shell's axis of revolution. The shell can include one or more light transmissive panels and an airflow system to control the temperature within the shell.

27 Claims, 15 Drawing Sheets

MANEUVERABLE ENTERTAINMENT AND TRAINING SYSTEM

CROSS-REFERENCE TO RELATED APPLICATION

This application claims the benefit under 35 U.S.C. §119 (e) of U.S. Provisional Patent Application No. 60/825,225 filed on Sep. 11, 2006, where this provisional application is incorporated herein by reference in its entirety.

BACKGROUND OF THE INVENTION

1. Field of the Invention

The present description generally relates to devices, systems, and methods for performing various sports related activities, in particular, for performing, enjoying, and training for gravity sports.

2. Description of the Related Art

The evolution of wheeled ground transportation and, roller sports in particular, has often been the catalyst for the development of adequate surfaces that can receive such transportation or roller devices. Wood floor roller rinks, roads of cement and asphalt, bike tracks, skate parks, snowboard half-pipes designed to Olympic standards, surfaces, terrain, equipment, and people's skills (and ambitions) have evolved and improved together. Additionally, the combination of all these improvements has given the rider the ability to navigate and maneuver steep descents and extreme terrain while continually being propelled by the force of gravity with greater proficiency. Unfortunately, these gravity sports require that a rider travels over a fixed surface, for example, a mountain slope or a roller rink.

Gravity sports performed on land (e.g., skateboarding, BMX racing, street luge, in-line skating, etc.), snow (e.g., snowboarding), and water (e.g., rafting), sometimes referred to as "alternative sports," continue to grow in popularity across the United States as well as in other countries. While the media tends to capture many of these activities in the context of TV programs and organized competitions (e.g., the X-Games on ESPN), many other prospective participants do not have adequate access to places to participate in, train, or practice these sports. In addition, many of these sports are seasonal, thus participants are restricted to either not participating in the sport or trying to find alternative venues to participate in the sport during the off-season. Similarly, as the popularity of such sports increases, fans and promoters are bringing large crowds to events that, by their nature, occur in remote locations, such as mountains or the desert. A consequence, as a result of and in reaction to these limitations, has been that, as these sports mature, there has also been continued evolution, adaptation, and refinement to the venues, the events, the equipment, the courses, the rules, and associated technology.

BRIEF SUMMARY

Some embodiments disclosed herein are directed to a gravity sports system that can be used in a wide range of locations. Embodiments of the present invention can be used for fun, exercise, competition, entertainment, building fundamentals, and/or training for gravity sports, such as skateboarding, snowboarding, or skiing.

In some embodiments, an exercise system includes a rotatable shell, a frame, and a drive system. The rotatable shell has an inner riding surface and a chamber defined at least in part by the inner riding surface. The chamber is dimensioned to receive a user (e.g., a human) that rides equipment along the inner riding surface. The frame movably supports the shell such that the shell is rotatable about the first axis of rotation that extends through the shell. The drive system is adapted to cause rotation of the shell about the first axis of rotation. The rotation can be independent of the user's movement inside of the chamber.

In some embodiments, the system further includes a tilting assembly having the support frame which is movable relative to a support surface on which the system rests. A shell actuator of the drive system is coupled to the frame and the shell. A frame actuator is adapted to tilt the frame and the shell while the shell actuator rotates the shell with respect to the frame.

In some embodiments, a gravity sports system compels dynamic reactions by a participant. The system includes a structural shell having a curved, continuous wall portion with a somewhat smooth interior surface. The curved, continuous wall is symmetrical (including mathematically symmetrical or substantially symmetrical) about an axis of revolution. The shell also has an ingress and egress location. A support frame supports the shell and reacts to any eccentric forces internally applied to the shell and inertial forces generated by movement of the shell. A rotation means directs the shell to rotate about an axis of rotation. The axis of rotation is coincident (including perfectively coincident or substantially coincident) with the axis of revolution about which the curved, continuous wall is formed. In some embodiments, for example, a substantial portion of the shell may be symmetrical about the axis of revolution. A controller controls a number of parameters defining the movement of the shell relative to a detached, fixed frame of reference.

In yet other embodiments, a system for compelling dynamic reactions by a participant is provided. The system includes a structural shell, a support frame, a drive system, and a controller. The structural shell has a curved, continuous wall portion and a location for egress and ingress. The wall portion has an inner ridable surface and is asymmetrical about an axis of revolution. The support frame structurally supports the shell during movement of the shell and reacts to any eccentric forces internally applied to the shell. The support frame also reacts to any inertial forces generated by movement of the shell. The drive system is configured to rotate the shell about an axis of rotation. The axis of rotation is substantially coincident with the axis of revolution. The controller controls the movement of the shell relative to the support frame.

In another aspect, a gravity sports system includes a structural shell having at least one continuously curved wall. The wall is defined by revolving a cross section of the curved wall about an axis of revolution. A rotation means connected to the shell rotates the shell about the axis of revolution. A tilting assembly tilts at least the shell along at least one plane. A first point on the shell is kinematically related to a second point located on the tilting assembly.

BRIEF DESCRIPTION OF THE SEVERAL VIEWS OF THE DRAWINGS

In the drawings, identical reference numbers identify similar elements or acts. The size and relative positions of elements in the drawings are not necessarily drawn to scale. For example, the shapes of various elements are not drawn to scale, and some of these elements are arbitrarily enlarged and positioned to improve drawing legibility. Further, the particular shapes and the elements are not intended to convey any information regarding the actual shape of the particular elements, and have been solely selected for their ease and recognition in the drawings.

DETAILED DESCRIPTION

The following description is generally directed towards a rotating shell large enough to permit a participant inside the shell to perform various maneuvers as the shell moves. The participant can operate various types of equipment, such as wheeled equipment (e.g., in-line skates, skateboards, street luge, etc.) or surface bearing equipment (e.g., skis, sleds, snowboards, etc.), inside the shell. The participant can guide the equipment over the inner surface of the shell as the shell rotates or tilts, or both.

Various embodiments of gravity sports systems discussed herein allow a person to ride a conventional gravity propelled device or other minimum friction device (e.g., a slippery body suit) and experience the effects and sensation of descending downhill aided by the force of gravity without traveling on or over fixed, stationary terrain. Furthermore, riders can subjectively interpret their descent by controlling and manipulating their equipment for the purpose of self-expression, fun, exercise, competition, exhibition, entertainment, or even to build fundamentals and to train for other sports, such as skateboarding, snowboarding, skiing, or surfing. Advantageously, various types of activities, such as skateboarding, can be simulated using the gravity sports system.

FIGS. 1-16 help provide a thorough understanding of the illustrated embodiments. One skilled in the art, however, will understand that the disclosed embodiments may have additional features, or that the embodiments may be practiced without several of the details described in the following description.

Generally, the number of degrees of freedom of a gravity sports system can be selected based on the desired riding experience. Even though some embodiments of the gravity sports system are a two-axis gimbal type system, the gravity sports system can be designed such that the shell is rotated about any number of axes (e.g., a single axis, multiple orthogonal axes, and the like). Additionally or alternatively, the shells can be linearly translated using a one or more linear drive systems, such as a rack and pinion system, piston arrangement, or other type of mechanical and/or electrical drive means.

Figure 1A:
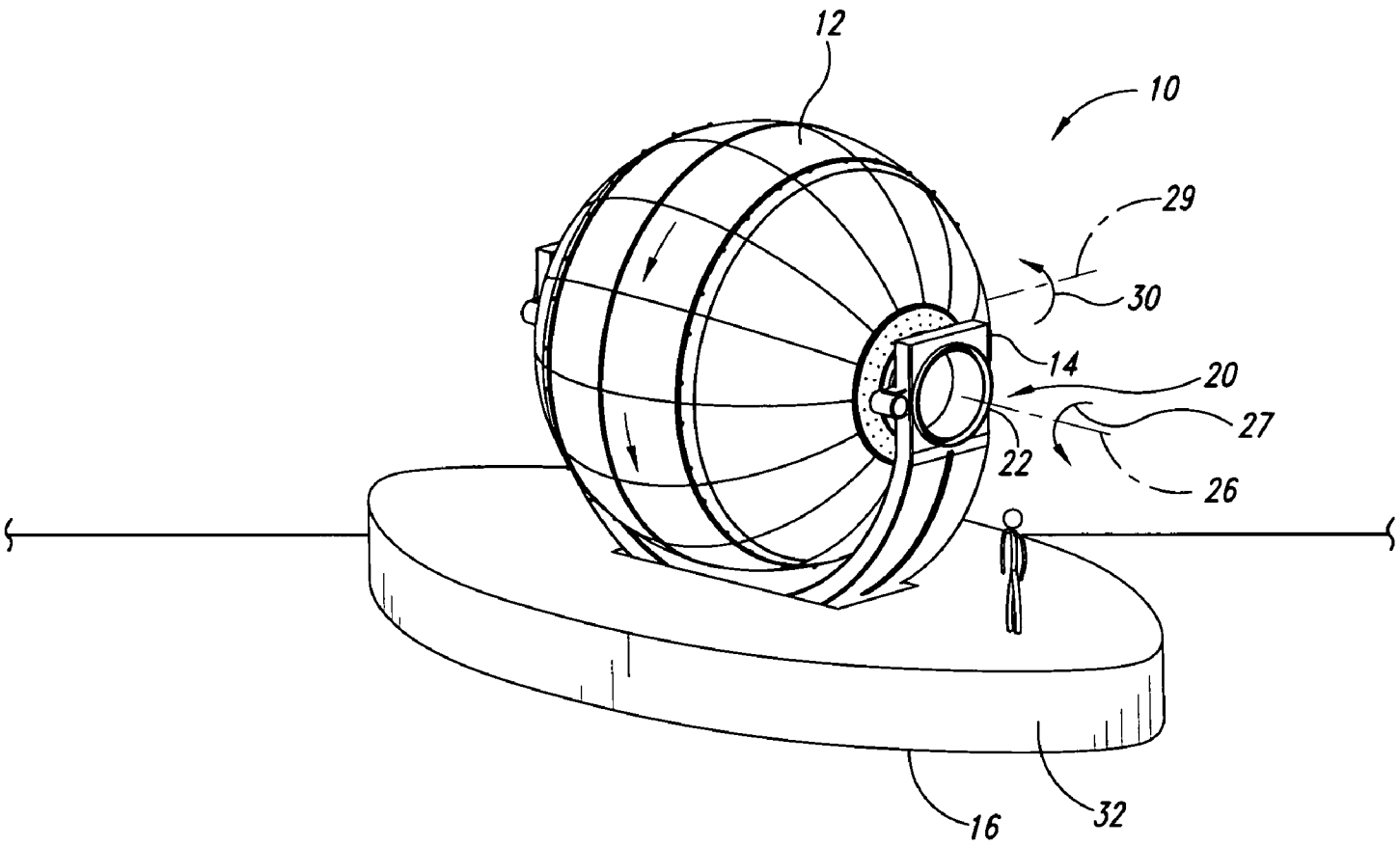
FIG. 1A is an isometric view of a gravity sports system according to one embodiment.
Figure 1B:
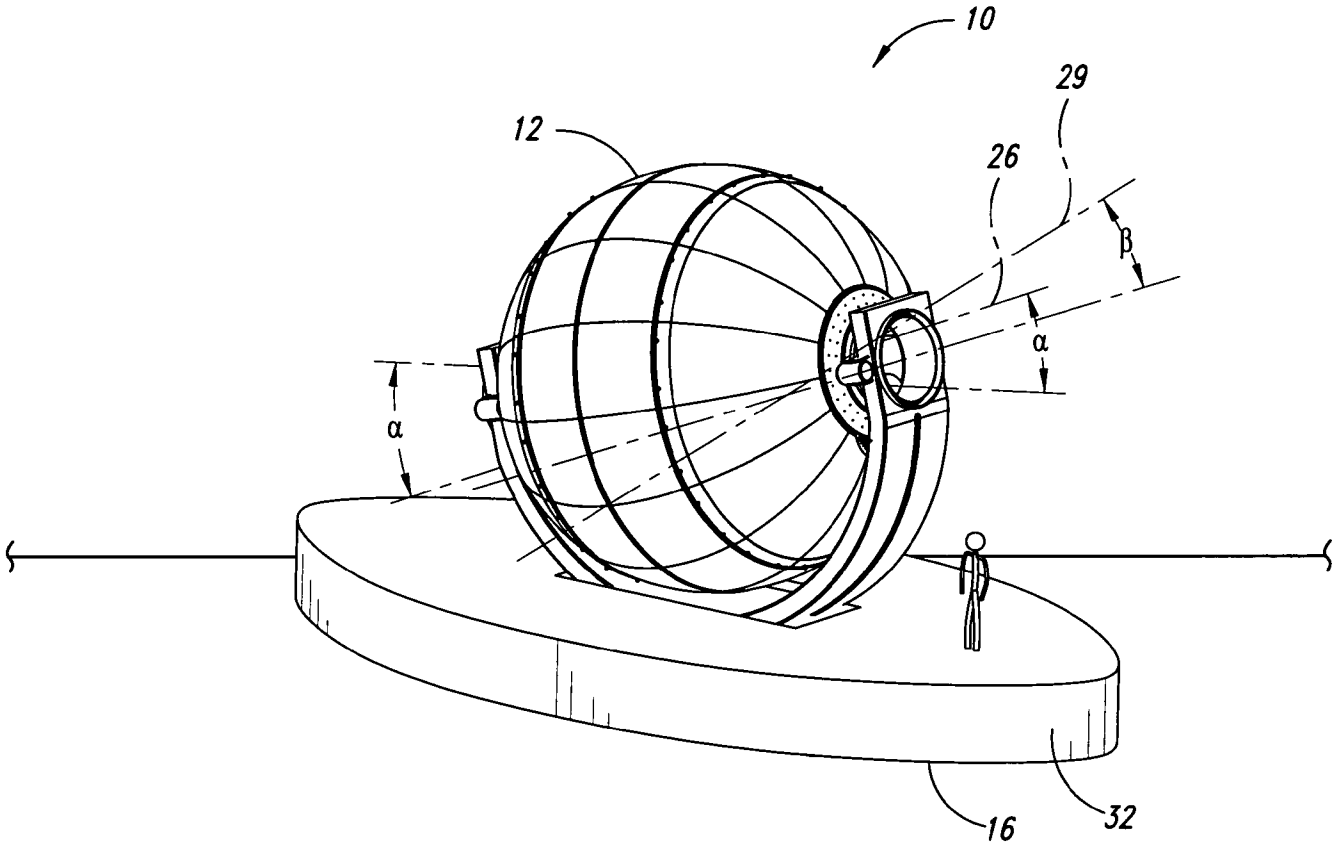
FIG. 1B is an isometric view of the gravity sports system of FIG. 1A showing a shell and a support frame moved relative to a platform assembly of the gravity sports system, in accordance with one illustrated embodiment.

FIGS. 1A and 1B illustrate a gravity sports system 10 including a movable shell 12 for holding one or more occupants, an actuatable frame 14 pivotally holding the shell 12, and a platform assembly 16 supporting the actuatable frame 14. The shell 12 has a spherical shape and can be moved to provide a desired riding experience to any users inside of the shell 12. The illustrated gravity sports system 10 also includes a drive system 20 having a shell actuator 22 for rotating the shell 12, and a frame actuator 24 (see FIGS. 2 and 3). The frame actuator 24 can move the actuatable frame 14, and the shell 12 carried by the frame 14, relative to the platform assembly 16.

The illustrated drive system 20 of FIG. 1A rotates the shell 12 about a first axis of rotation 26 (e.g., in the direction indicated by the arrow 27), and can also rotate the actuatable frame 14 and the shell 12 about a second axis of rotation 29 (e.g., in the direction indicated by the arrow 30). The first axis of rotation 26 may be generally perpendicular to the second axis of rotation 29. The shell 12 and the actuatable frame 14 can be moved between various orientations based on the desired riding experience.

In some embodiments, including the illustrated embodiment of FIGS. 1A and 1B, the shell 12 and frame 14 are rotated about the second axis of rotation 29 an angle $\alpha$, and the shell 12 is rotated about the first axis of rotation 26 at the desired angular speed. In some non-limiting embodiments, the angle $\alpha$ can be equal to or less than about 200°, 180°, 150°, 110°, or 90°, or ranges encompassing such angles. Other angles are also possible.

The sports gravity system 10 can thus be operated to accommodate a wide range of rider skill levels (e.g., novice, intermediate, expert, etc.), and various types of riding equipment. The frame 14 carrying the movable shell 12 can be rotated while the shell 12 continuously rotates relative to the frame 14. Because of the motion of the shell 12, a user riding equipment in the shell 12 may be forced to continually perform maneuvers, including adjusting body position and balancing. In order to reduce or substantially eliminate eccentric motion of the shell 12, the first and second axes 26, 29 can pass through or are near the center of gravity of the shell 12.

Figure 2:
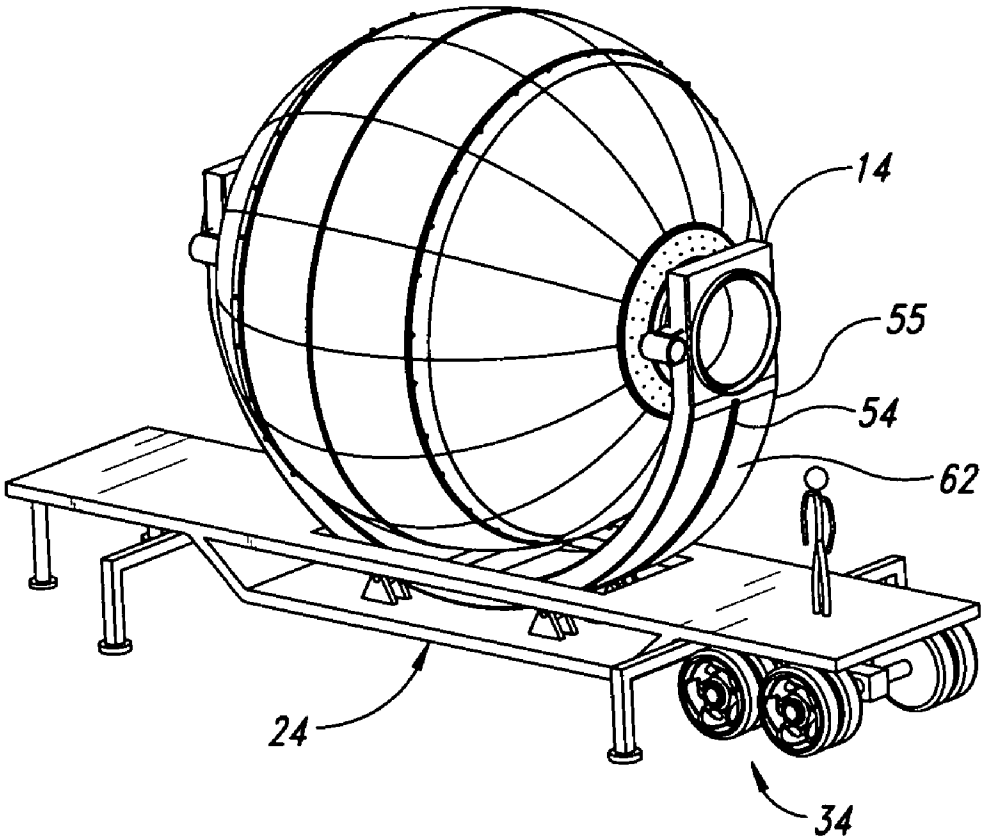
FIG. 2 is an isometric view of a gravity sports system having a platform assembly with a cover shown removed in accordance with one illustrated embodiment.

With reference to FIGS. 1A-2, the platform assembly 16 includes a cover 32 (see FIGS. 1A and 1B) and a wheeled transportation assembly 34 (see FIG. 2). The cover 32 has been removed in FIG. 2. The transportation assembly 34 can be pulled by a vehicle, such as a truck, to conveniently transport the gravity sports system 10 on a roadway or other surfaces, if needed or desired.

Figure 3:
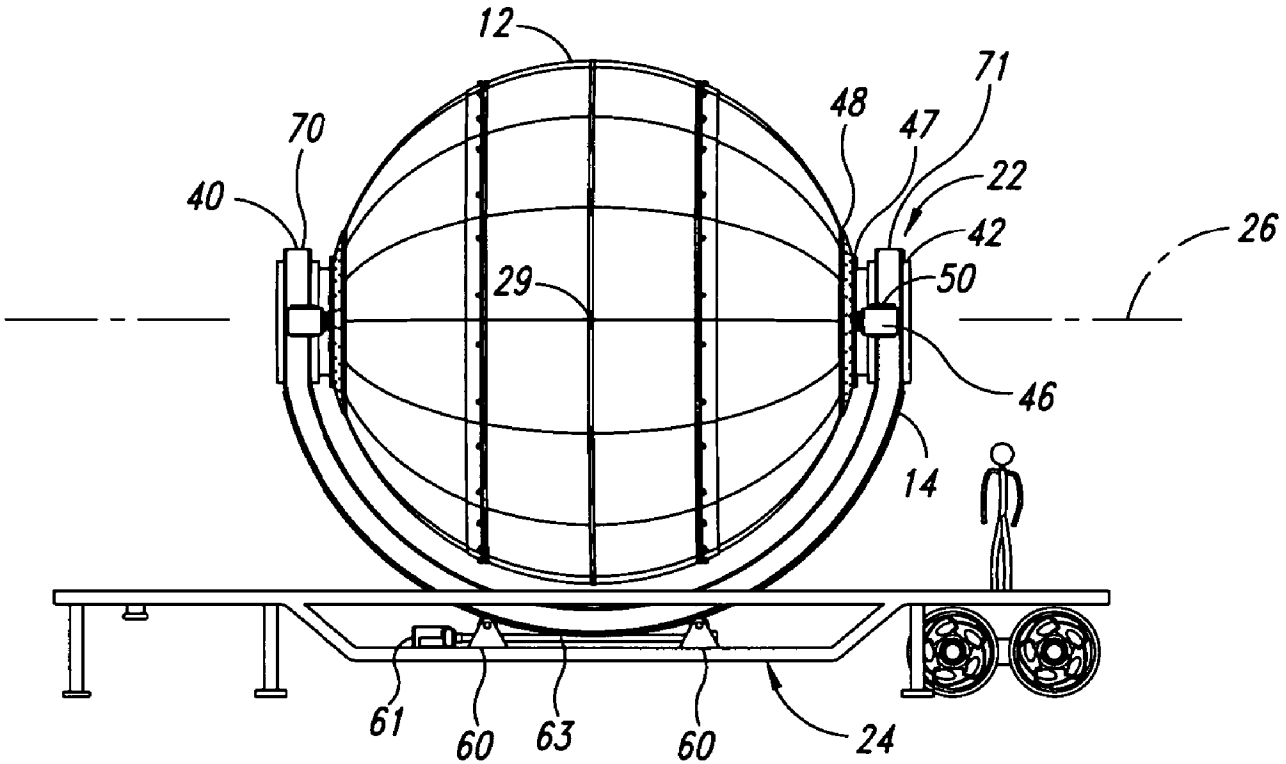
FIG. 3 is a front elevational view of a gravity sports system in accordance with one embodiment.

Referring to FIG. 3, the shell actuator 22 includes a pair of hub drive assemblies 40, 42 for imparting rotary motion to the shell 12. The illustrated shell 12 is interposed between the diametrically opposing hub drive assemblies 40, 42 that cooperate to define the first axis of rotation 26 extending through the shell 12. The hub drive assemblies 40, 42 can be generally similar to each other. Accordingly, the description of one hub drive assembly applies equally to the other.

Figure 4:
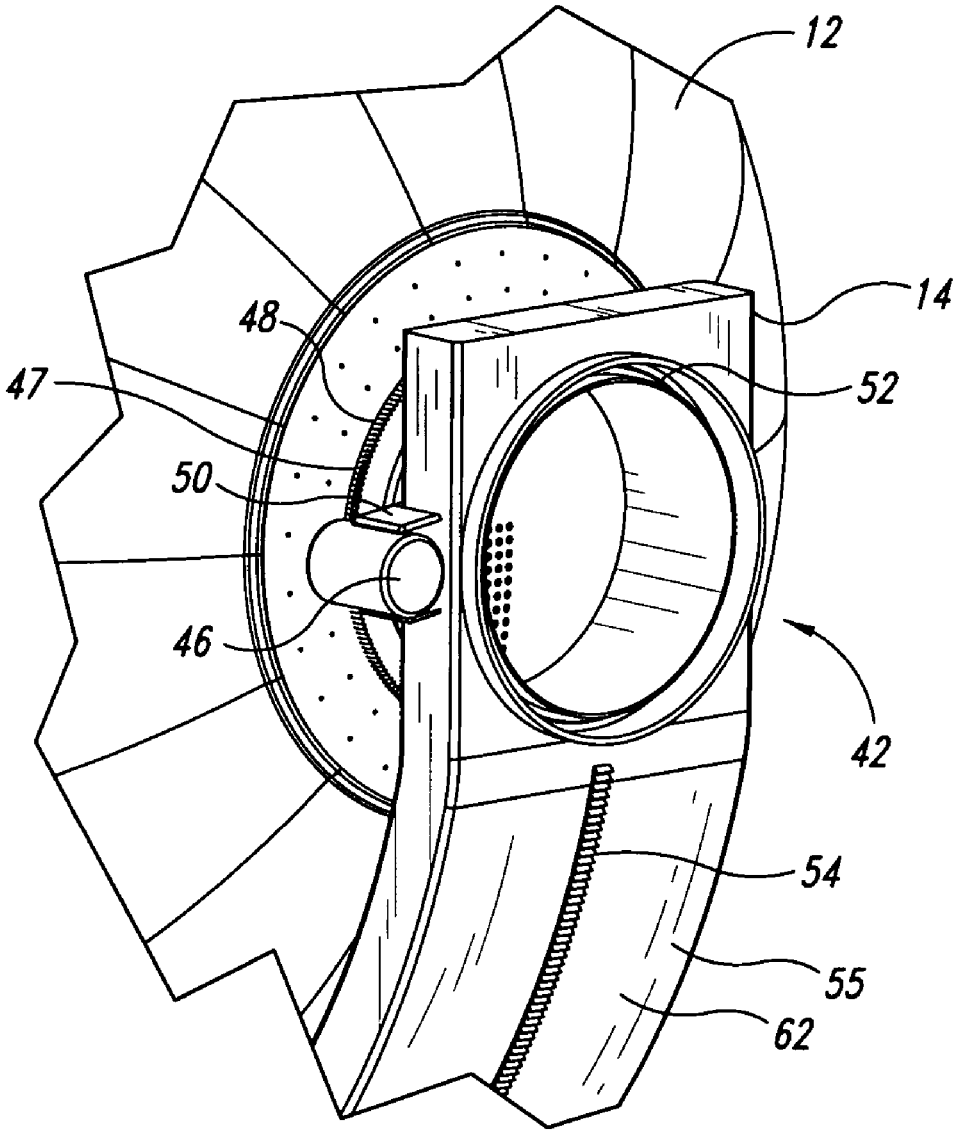
FIG. 4 is a detailed view of a hub drive assembly of a gravity sports system according to one embodiment.
Figure 5:
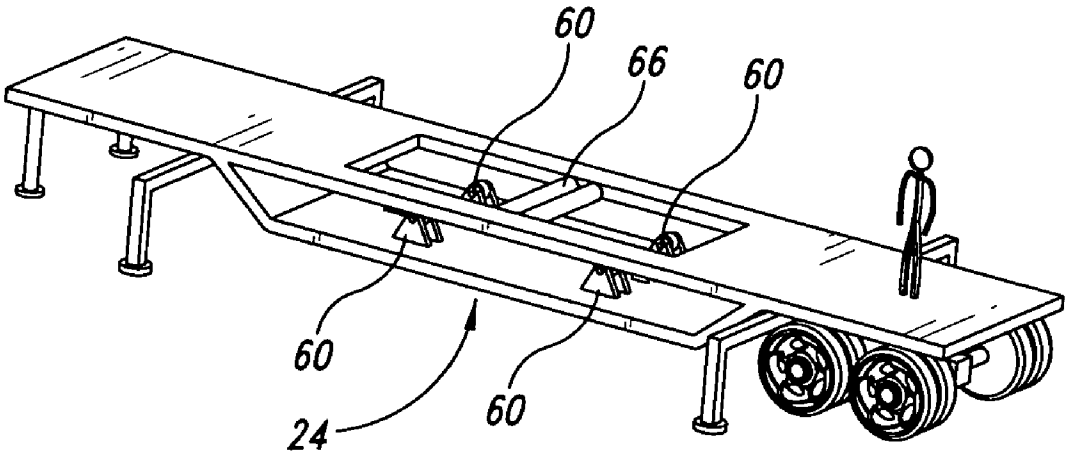
FIG. 5 is an isometric view of a transportation system of a platform assembly according to one embodiment.

The hub drive assembly 42 of FIGS. 3 and 4 includes a motor 46 that pivotally engages one or more engagement features 47 (illustrated as teeth) of a gear 48 fixedly coupled to the shell 12. The motor 46 is fixedly coupled to the frame 14 via a motor mount 50. FIG. 4 shows a bearing assembly 52 of the hub drive assembly 42 that pivotally connects the shell 12 to the frame 14.

The gear 48 can be integrated into the shell 28. In some embodiments, for example, the gear 48 can be monolithically formed with the shell 12 using, for example, a molding process, machining process, and the like. In other embodiments, the gear 48 is temporarily or permanently coupled to the shell 12 using one or more fasteners (e.g., bolts, screws, mechanical fasteners, etc.), adhesives, welding, and the like.

The motor 46 is adapted to rotate the shell 12 at a desired angular speed. As used herein, the term "motor" is a broad term and includes, without limitation, one or more devices capable of imparting rotary motion. The motor 46 can be in the form of a stepper motor, drive motor, gas motor, permanent magnet motor, and the like. Any number of motors can be used to impart the desired motion to the shell 12.

The motor 46 of FIGS. 3 and 4 can include one or more engagement features, such as a spur gear connected to a drive shaft. Such engagement features can be configured to drivingly engage the gear 48. Other types of engagement features, such as drive belts, drive chains, and the like, can also be used. Based on the properties of the movable shell 12 (e.g., size, mass, moment of inertia, rotational inertia, center of gravity, etc.) and desired operating parameters (e.g., the rotational speed of the shell 12), one of ordinary skill in the art can select the type and amount of power outputted from the motor 46.

Referring to FIGS. 2 and 4, the frame 14 includes a drive feature 54 for engaging the frame actuator 24. The illustrated drive feature 54 is in the form of a row of teeth extending longitudinally along a main body 55 of the frame 14. A plurality of lower roller assemblies 60 (see FIG. 5) can bear against a curved outer surface 62 of the actuatable frame 14. A motor 61 (FIG. 3) can rotate the lower roller assemblies 60 via a drive train 63. An upper roller assembly 66 (illustrated as a pair of rollers in FIG. 5) can be spaced from the lower roller assemblies 60 such that the frame 14 is sandwiched between the lower and upper roller assemblies 60, 66. In this manner, the frame 14 can be slidably retained by the platform assembly 16 and may travel along a desired path (e.g., a semi-circular or arcuate path).

Referring again to FIG. 3, the actuatable frame 14 has a generally semi-circular shape for relatively smooth rotation about the second axis of rotation 29. Arcuate arms 70, 71 extend upwardly along opposing sides of the shell 12. Other types of frame configurations are also possible. For example, the actuatable frame 14 can be an annular ring that closely surrounds the equator of the shell 12.

Figure 6:
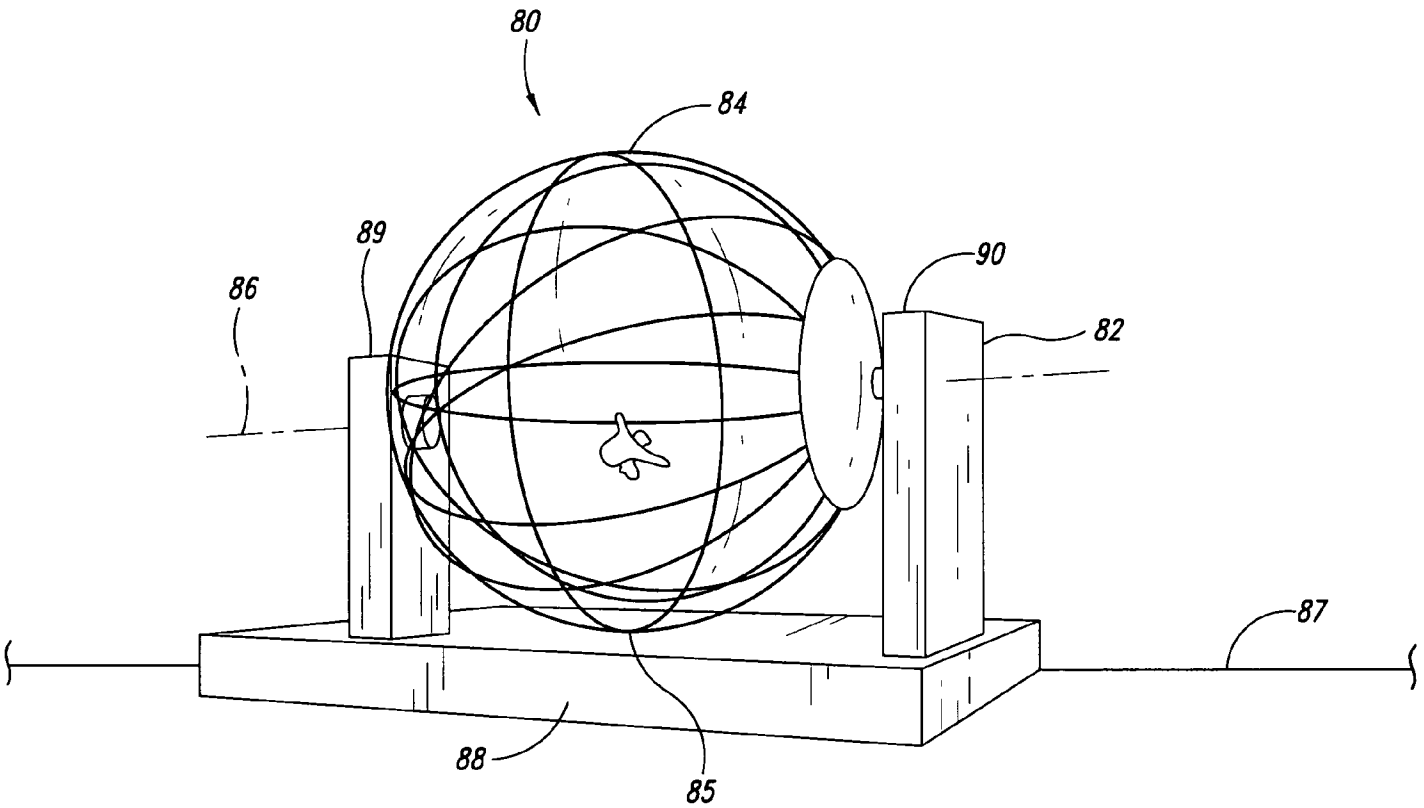
FIG. 6 is an isometric view of a gravity sports system according to another embodiment.
Figure 7:
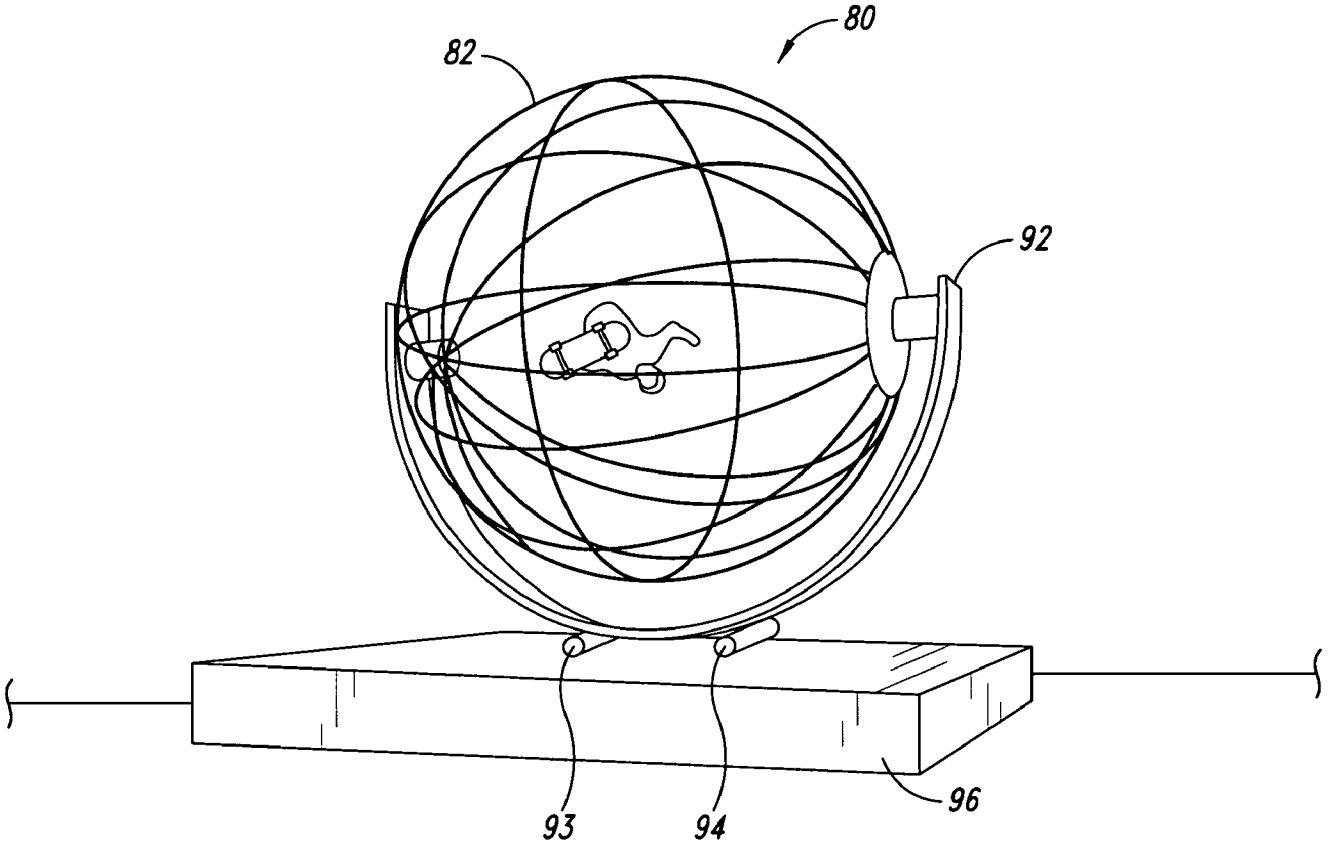
FIG. 7 is an isometric view of a gravity sports system according to yet another embodiment.

FIGS. 6 and 7 illustrate embodiments of the gravity sports systems that may be generally similar to the embodiment illustrated in FIGS. 1A-5, except as detailed below. In FIG. 6, a gravity sports system 80 includes a stationary support frame 82 that permits only rotation of a shell 84. The illustrated frame 82 defines an axis of rotation 86 that is generally parallel to a support surface 87 on which the gravity sports system 80 rests. The axis of rotation 86 can also be at other orientations, if needed or desired.

The frame 82 can be rigidly coupled to a platform assembly 88. The illustrated frame 82, for example, includes a pair of vertically extending arms 89, 90. The shell 84 is interposed between and supported by the arms 89, 90. The bottommost section 85 of the shell 84 is held at least a slightly above the platform assembly 88 by the arms 89, 90. The height of the arms 89, 90 can be selected to achieve the desired clearance between the shell 84 and the platform assembly 88.

FIG. 7 illustrates a frame 92 that is on rollers 93, 94. Similar to the frame 14 of FIGS. 1A-5, the frame 92 may function as a track. The track of the frame 92 can have a groove that receives the rollers 93, 94, which in turn, permit the frame 92 to be moved along a generally semi-circular path, or other type of path. The frame 92 can be moved either manually or via some mechanical means.

Figure 8A:
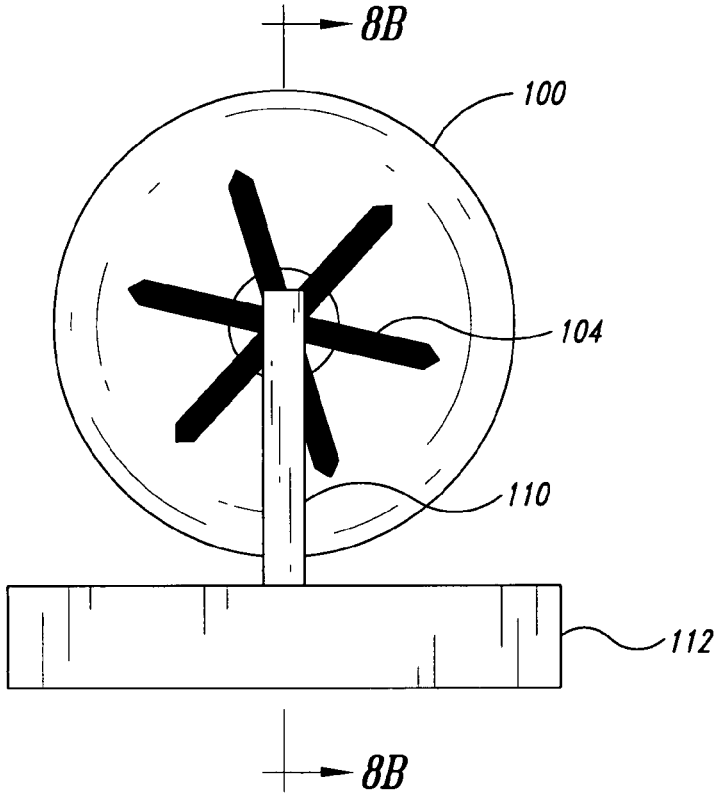
FIG. 8A is a side elevational view of a gravity sports system having a torus-shaped shell according to one embodiment.
Figure 8B:
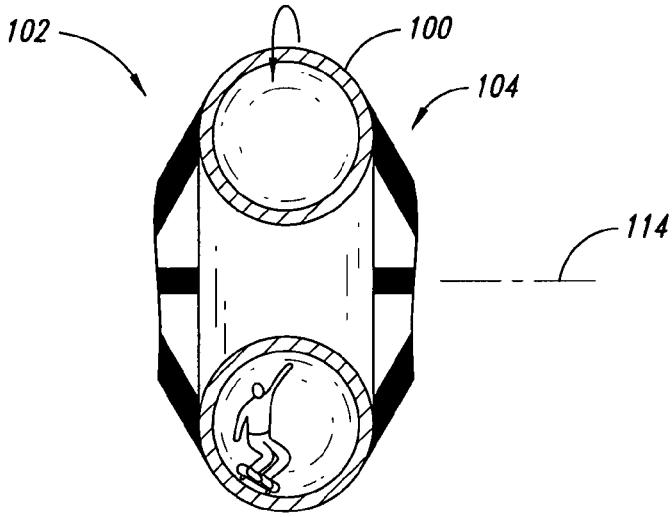
FIG. 8B is a cross-sectional view of the gravity sports system of FIG. 8A, shown along section 8B-8B.

FIGS. 8A through 8D illustrate another sports system according to another embodiment of the invention. A shell 100 shown in FIG. 8A is formed in the shape of a torus (e.g., doughnut-shaped). The torus-shaped shell 100 of the illustrated embodiment can be attached to two sets of elongated members. The elongated members can be, without limitation, beams, spokes, rods, and the like. As shown in FIG. 8B, the shell 100 is interposed between two sets of the elongated members 102, 104. Each of the two sets of elongated members 102, 104 can be rotationally connected to a frame 110 (see FIG. 8A). Similar to the above embodiments, the frame 110 can be supported by a platform assembly 112.

In FIG. 8B, the torus-shaped shell 100 can be rotated about an axis of rotation 114. In the illustrated embodiment, the axis of rotation 114 is a central axis oriented generally horizontally when the platform assembly 112 rests on a generally horizontal support surface.

Figure 8C:
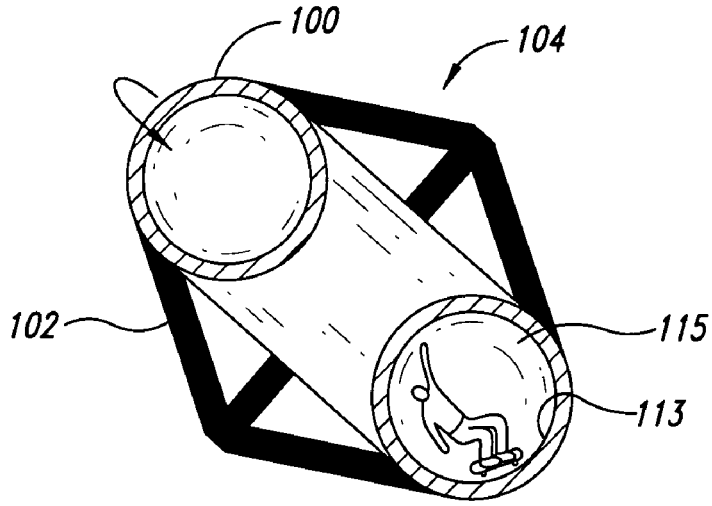
FIG. 8C is a cross-sectional view of the gravity sports system of FIG. 8A along section 8B-8B, where the axis of revolution of the gravity sports system has been tilted.

The shell 100 can also be in other orientations, if needed or desired. As shown in FIG. 8C, the torus-shaped shell 100 can also be tilted. The action of the shell 100 permits a rider to gain speed relative to an inner riding surface 113 of the shell 100 while the combined rotation and tilting action challenges the rider to continually maneuver within the shell 100. As such, the rider can ride smoothly along the inner riding surface 113 about the periphery of the shell 100.

Figure 8D:
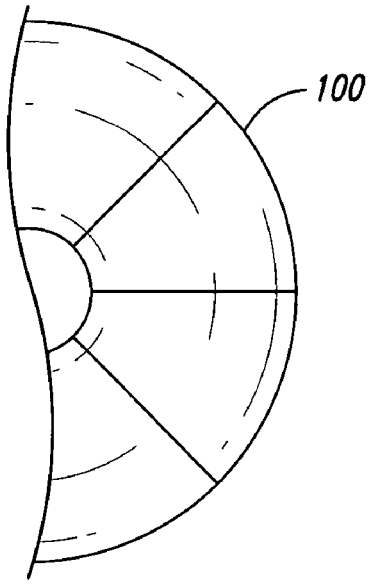
FIG. 8D is an elevational view of a portion of the torus-shaped shell illustrated in the gravity sports system of FIG. 8A.

In FIG. 8D, one-half of the torus-shaped shell 110 is illustrated. The shell 110 can include a series of pie-shaped wedges assembled together. Each wedge can have an appropriate three-dimensional curvature to define the desired inner riding surface 113 and chamber 115 for receiving the rider.

Figure 9:
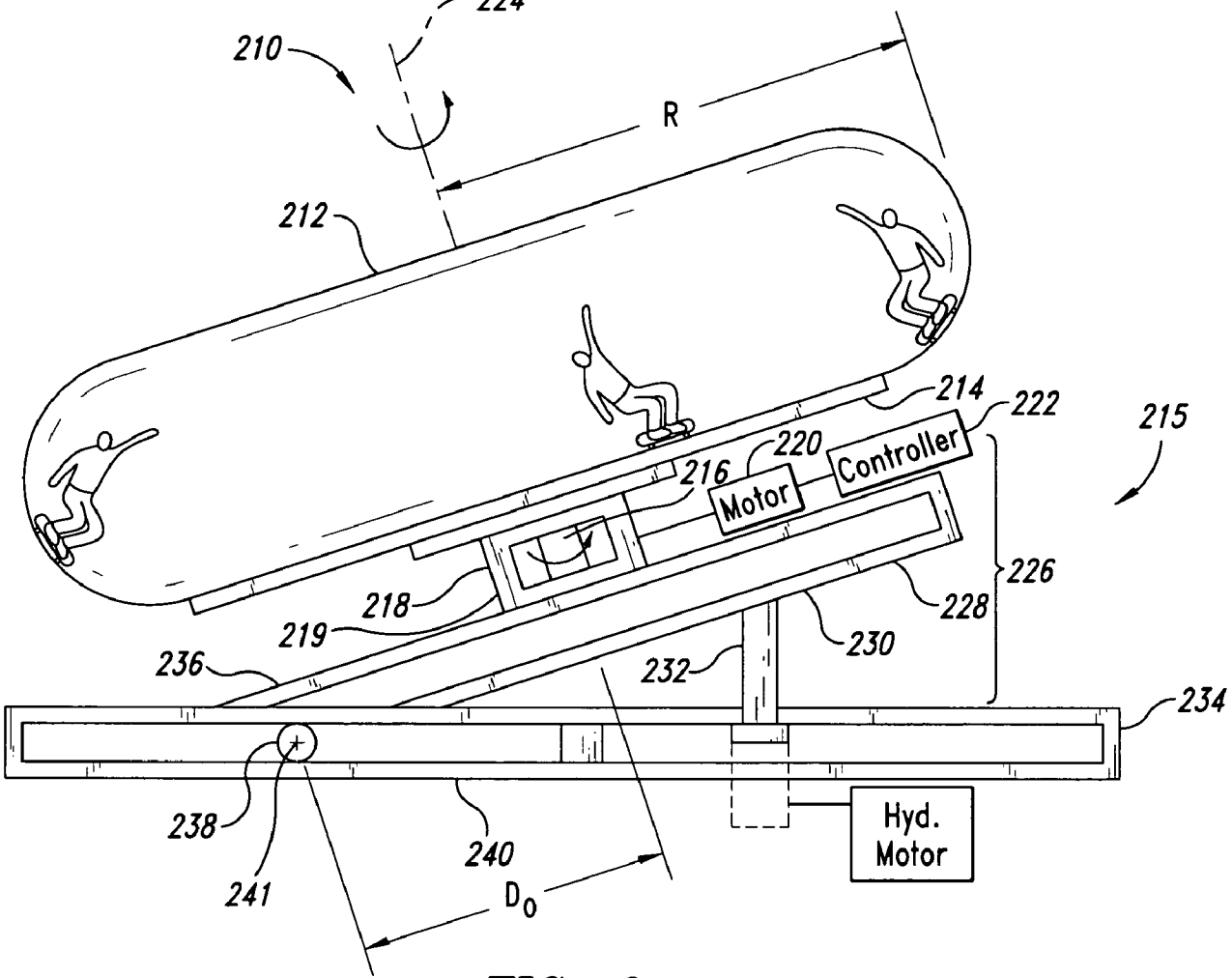
FIG. 9 is a side elevational view schematically illustrating a gravity sports system according to another embodiment.

FIG. 9 illustrates a sports system 210 according to another embodiment. The system 210 is comprised of a structural shell 212 mounted to a support member 214. The sports system 210 includes a drive assembly 215 having a hub drive assembly 219 in the form of a rotor assembly, a motor 220, and a controller 222 in communication with the motor 220.

The shell 212 and support member 214 are rotationally attached to the rotor assembly 219, which includes a rotor 216 housed in a rotor housing 218. The motor 220 drives the rotor 216, which in turn drives the shell 212. The controller 222 communicates with the motor 220 to control one or more operating parameters, such as the speed (e.g., rotational speed) of the shell 212, position of the shell 212, and the like. For example, the angular acceleration and deceleration of the shell 212 about an axis of rotation 224 can be controlled. Additionally and alternatively, the controller 222 can be programmable using computer software programs or modules.

Further illustrated in FIG. 9 is a tilting assembly 226 of the drive assembly 215 for tilting the shell 212. The tilting assembly 226 can include a structural support frame 228. The rotor housing 218 can be temporarily or permanently coupled to the frame 228. A first portion 230 of the frame 228 is attached to a means for raising and lowering the frame 228. The means for raising and lowering the first portion 230 of the structural frame 228 can be an actuator 232 (e.g., a pneumatic actuator, hydraulic actuator, piston arrangement, and the like), for example, or some other mechanical or electromechanical assembly. The illustrated actuator 232 is supported by a platform assembly 234. A second portion 236 of the structural frame 228, as shown in the illustrated embodiment, is configured with an attached roller 238. A track assembly 240 supports the roller 238.

In some embodiments, including the illustrated embodiment of FIG. 9, the system 210 includes an axis of rotation 241 defined by the roller 238 that is offset from the axis of rotation 224. The axis of rotation 224 extends through the shell 212, but the axis of rotation 241 is spaced from the shell 212. The distance of offset of the axis of rotation 241 can be selected to achieve the desired tilting action. For example, the axis of rotation 224 can be separated from the axis of rotation 241 by a distance $D_o$. The distance $D_o$ can be generally equal to the radius R of the shell 212. In other embodiments, the distance $D_o$ can be less than or greater than the radius R.

Figure 10:
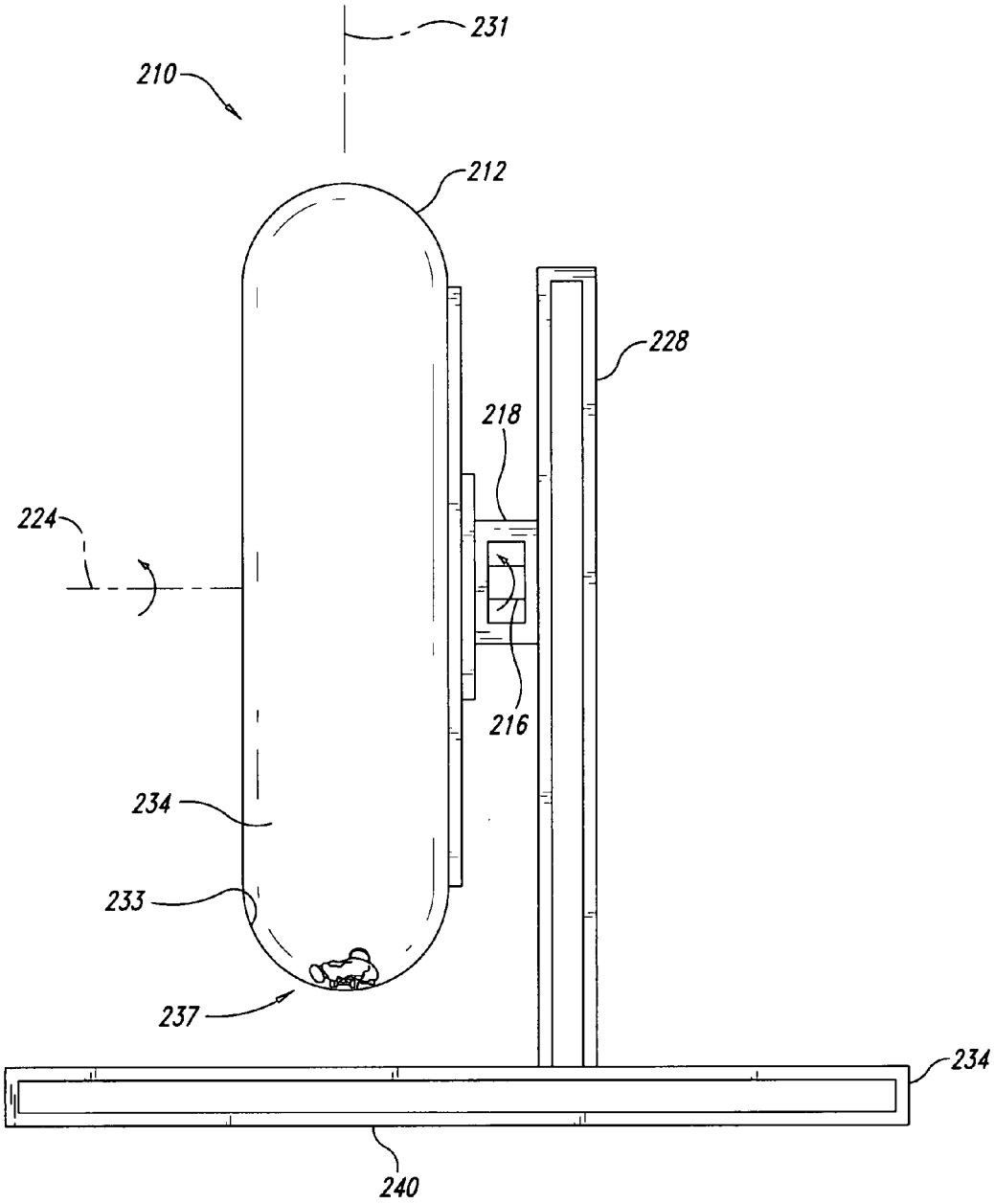
FIG. 10 is a side elevational view of a gravity sports system according to yet another embodiment.

Advantageously, the tilting assembly 226 of FIG. 9 can be used to move the shell 212 of FIG. 9 into the shell position illustrated in FIG. 10. FIG. 10 illustrates the sports system 210 without any tilting assembly. In the illustrated embodiment, the structural support frame 228 extends vertically upward from the platform assembly 234. The axis of rotation 224 extends generally horizontally and, in some embodiments, perpendicularly to a centerline or center plane 231 of the shell 212. As such, the rider (illustrated on a luge sled) can ride along the outermost periphery 237 of a chamber 234.

Shell Configuration

Figure 11A:
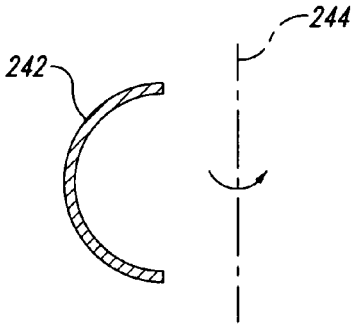
FIG. 11A is a cross-sectional view of a curved structure that can be revolved about an axis of revolution to form a portion of a structural shell according to one embodiment.
Figure 11B:
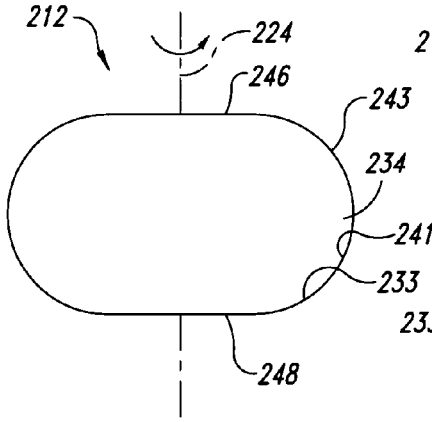
FIGS. 11B and 11C are elevational views of structural shells that can be formed from the curved structure of FIG. 11A.
Figure 11C:
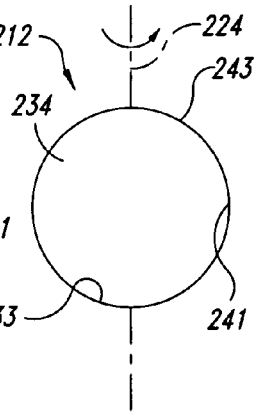

FIGS. 11B and 11C illustrate configurations of the shell 212 according to embodiments of the invention in which a feature 242 of FIG. 11A is revolved around an axis of revolution. The geometric shape of the shell 212 is defined, in part, by revolving the curved solid 242 (FIG. 11A) about an axis of revolution 244 to form a wall 243 (FIGS. 11B and 11C). The axis of revolution 244 can be coincident with the axis of rotation 224 after the shell 212 is formed. The manufacturing tolerances can be adjusted to minimize, limit, or substantially prevent eccentric or unbalanced movement of the shell 212. The chamber 234 can be dimensioned to receive a user that rides equipment along the inner riding surface 233. At least a portion of the inner riding surface 233 may define the chamber 234.

Figure 12A:
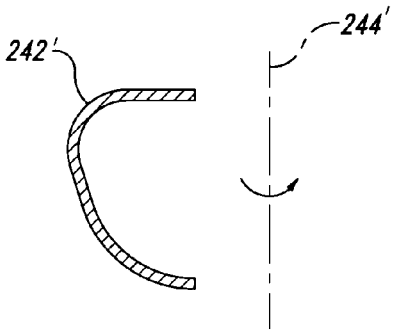
FIG. 12A is a cross-sectional view of another curved structure that can be revolved about an axis of revolution to form a portion of a structural shell according to another embodiment.
Figure 12B:
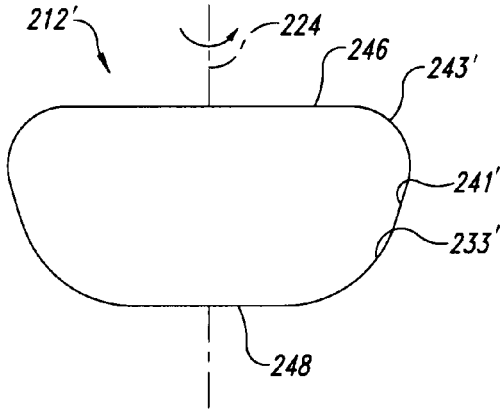
FIG. 12B is an elevational view of a structural shell formed from the curved structure of FIG. 12A.
Figure 13A:
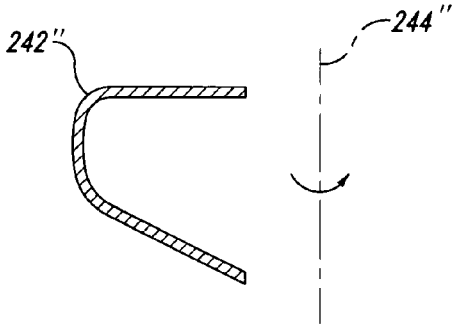
FIG. 13A is a cross-sectional view of yet another curved structure that can be revolved about an axis of revolution to form a structural shell according to yet another embodiment.
Figure 13B:
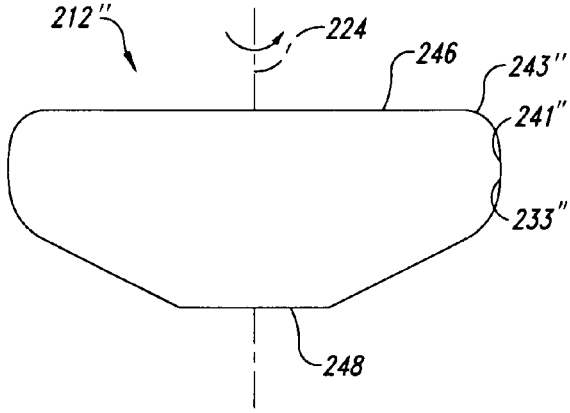
FIG. 13B is an elevational view of a structural shell formed from the curved structure of FIG. 13A.

The curved solid 242 can take the shape of a simple curve, as illustrated in FIG. 11A, or can take the shape of a more complex curve as illustrated in FIGS. 12A and 13A. As used herein, the term "curve" is broadly construed to include, but is not limited to, non-linear curves that may or may not include one or more linear sections.

FIGS. 11B, 11C, 12B, and 13B illustrate shells 212, 212' and 212" having walls 243, 243' and 243", respectively. The walls 243, 243' and 243" form the physical riding surfaces and chambers for the users. The curved solids 242, 242', 242" can take many shapes, for example, semi-circular, semi-elliptical, parabolic, linear, or some combination of these geometric shapes. The illustrated walls 243, 243' and 243" define sections 241, 241', 241" of the inner riding surfaces 233, 233', 233". The sections 241, 241', 241" are lateral sides of the chambers relative to the respective axes of rotation 244, 244', 244". In some embodiments, the sections 241, 241', 241" are peripheral sections that extend radially about and longitudinally along the axes of rotation 244, 244', 244". Additionally, the peripheral sections 241, 241', 241" can be a radially outermost sections of the inner riding surfaces 233, 233', 233" with respect to the axis of rotation.

Figure 14:
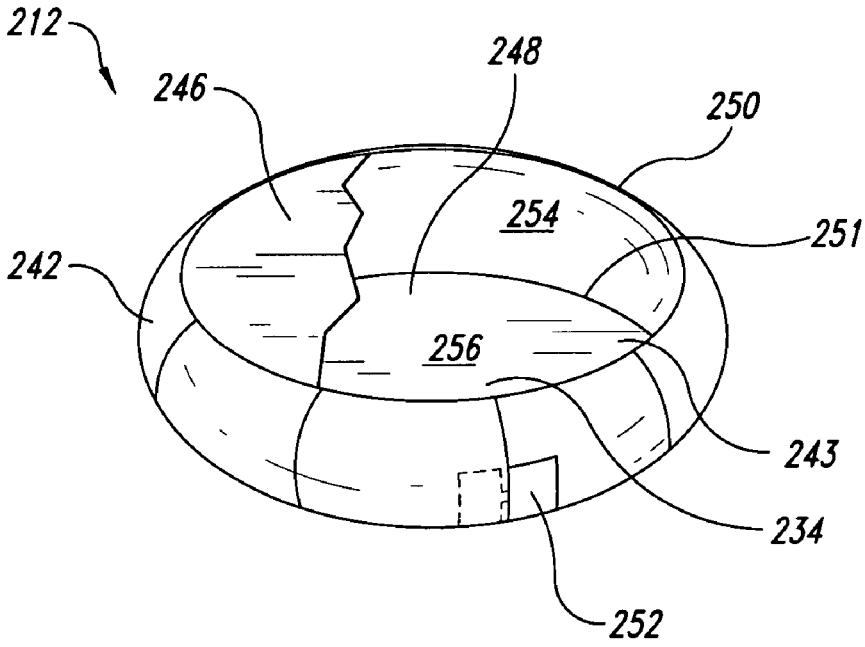
FIG. 14 is an isometric view of a structural shell having a floor member and a covering member according to one embodiment.

Referring to FIG. 14, the illustrated shell 212 has a continual wall 243. A roof member 246, shown partially cut away for clarity, and a floor member 248 are connected to the upper and lower edges 250, 251 of the wall 243, respectively. In addition, an access region 252 is located along the wall 243 to permit participant ingress and egress of the shell 212. In the illustrated embodiment, the access region 252 is configured to be opened from outside the shell 212. The access region 252 can include a door hinged in a manner similar to that of an airplane door such that the door 253 can be pulled outwardly away from the wall 243 and translated laterally with respect to the shell 212. Alternatively, the door 253 can be detachable from the shell 212. The door 253 shown in phantom in FIG. 14 illustrates the position of the door 253 when it is in an open position.

The interior surface 254 of the wall 243 and the interior surface 256 of the floor member 248 can be substantially smooth. The smooth interior surfaces 254/256 permit a participant to move throughout the shell 212 on wheeled devices, for example roller blades, skateboards, or street luge boards. A participant could also use surface bearing devices such as skis, sleds, or snowboards, for example. The smoothness of the inner surfaces of the shell 212 can be selected based on the equipment used in the shell 212. For example, the interior surfaces 254/256 for use with a snowboard may be smoother than interior surfaces 254/256 for use with roller blades.

The wall 243 can be made, in whole or in part, of metals, polymers, plastics, composites, wood, or combinations thereof. In some embodiments, the wall 243 is made from a rigid, synthetic material, such as plastic, acrylic, LEXAN®, VIVAK HT®, or MAKROLON®. LEXAN® is the registered trademark of the General Electric Company. VIVAK HT® is the registered trademark of Sheffield Plastics, Inc. MAKROLON® is the registered trademark of the Miles Chemical Corporation. At least a portion of the wall 243 can be transparent or light transmissive.

As noted above, the shell 212 can be dimensioned to receive one or more occupants. The diameter of the shell 212, in some embodiments, can be in the range of about 14 feet to about 40 feet. In some embodiments, the dimension (e.g., diameter, maximal dimension, and the like) of the shell 212 or chamber 234 can be greater than about 8 feet, 10 feet, 20 feet, 30 feet, or 40 feet, or ranges encompassing such dimensions.

Figure 15:
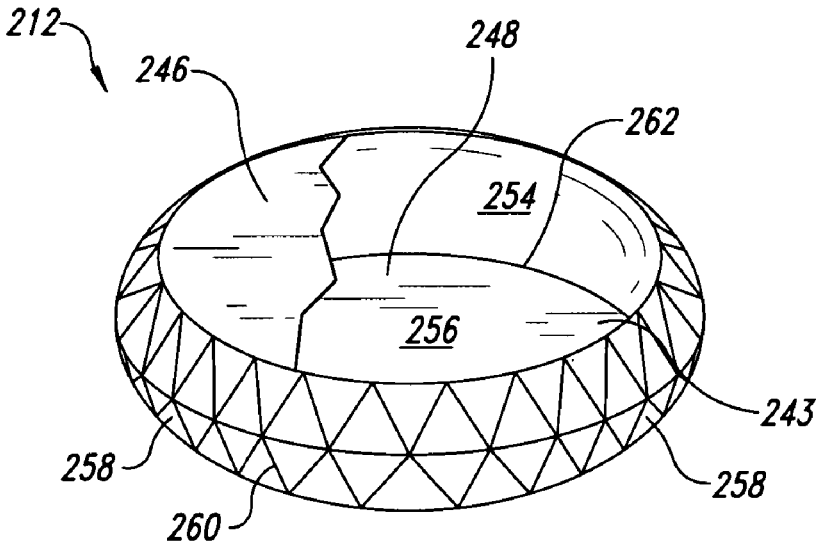
FIG. 15 is an isometric view of the structural shell of FIG. 14 assembled with adjoining components according to another embodiment.

FIG. 15 illustrates the shell 212 made by assembling a number of component segments 258. Seams 260 created when the component segments 258 are joined can be sealed and smoothed with respect to the interior surface 254 of the curved solid 242. Likewise, the seam 262 along the region adjoining the curved solid 242 and the floor member 248 can be sealed and smoothed to establish a smooth transition between the curved solid 242 and the floor member 248.

The roof member 246 can be detachable from the wall 243. The roof member 246 can be generally planar, curved, and/or dome-shaped, as well as any other suitable configuration for providing a riding surface. Additionally or alternatively, the shell 212 can have an open top. For example, the top member 246 can be eliminated such that the shell 212 is open to the surrounding environment.

Figure 16:
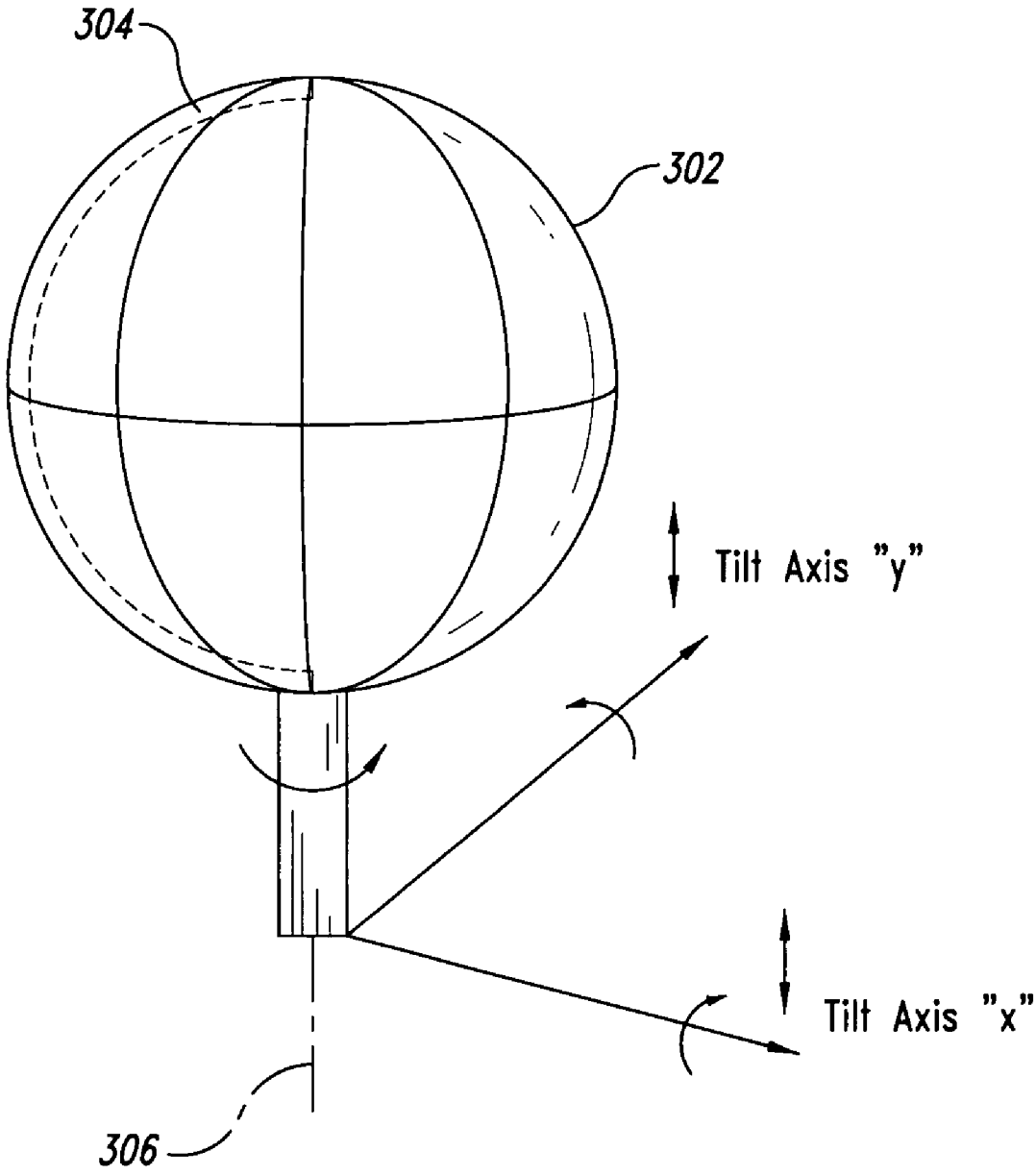
FIG. 16 is a perspective view schematically illustrating a structural shell with various axes for rotation and tilting of the shell according to one embodiment.

FIG. 16 schematically illustrates a shell 302 according to another embodiment. In the illustrated embodiment, the geometric shape of the shell 302 is spherical and made by revolving a semi-circular shaped solid 304 about an axis of revolution 306. The inside diameter of the sphere can be in the range of about 14 feet to about 40 feet. Other diameters are also possible. In addition, the shell 302 can be moved about two perpendicular tilt axes x, y, therefore providing enhanced maneuverability for the shell 302. The tilt axes x, y are offset from axis 306, which the shell 302 may rotate about. The shell 302 can be translated (e.g., in the direction of the axis of revolution 306) and rotatable about any number of axes.

Shell Operation

The operation of the shell 12 according to the illustrated embodiment of FIG. 1A begins with a rider entering the shell 12 through the door while the shell 12 is in a stationary position. Depending on the configuration of the door, the rider can secure the door or an operator can secure the door (e.g., a door similar to the door 252 of FIG. 14) from outside of the shell 12. The rider can use a variety of equipment (e.g., a skateboard, roller skates, a bike, a street luge, etc.) to ride on the inner riding surfaces through a chamber of the shell 12.

In some embodiments, the rider can elect certain operating parameters for the shell 12 before, after, and/or while entering the shell 12. In the embodiment of FIG. 9, a computing system can be configured to communicate with the controller (e.g., the controller 222), the motor 220, and the tilting assembly 226. Additionally or alternatively, the computing system can have a selection menu for permitting the rider to choose from a number of pre-programmed rides. In an alternative embodiment, an operator located externally to the shell can control the operation of the shell.

Some of the operating parameters of the shell that can be varied, include, without limitation, rotational speed (revolutions per minute), direction of rotation, tilt, linear speed, and elevation. As the shell 212 begins to rotate in FIG. 9, the rider begins moving across the interior surfaces of the shell 212. Initially, the rider may elect to follow the gravitational fall line as the shell 212 is tilted. As the speed and orientation of the shell 212 are varied, the rider can ride from a low point in the shell 212 to a higher point up along the wall 243. The rider's speed, direction of travel, elevation, or any combination thereof can be varied by steering the equipment in and out of the gravitational fall line. The rotation of the shell 212 about the rotor 216 creates a centrifugal effect allowing the rider to continually ride upon the interior surface 254 of the curved solid 242, if desired.

One skilled in the art will understand and appreciate that the sports gravity system described above may include other features for enhancing the aesthetic appeal of the shell, enhancing the environment within the shell, and/or enhancing the maintenance requirements of the shell. As one example, the shell can have a smooth, internal liner that can be adhered or attached to the interior surface of the shell. The liner provides the riding surface and can be replaced in the event it is worn out. The liner may protect the shell from scratches, wear, or any other deteriorative effects.

The shell can also be portable. The frame and/or platform can be configured to be attached to a vehicle, such as a truck. In the alternative, the entire gravity sports system can be modularly constructed so that the various components can be easily disassembled, replaced, transported, and the like.

With respect to enhancing the aesthetic appeal or the environment within the shell, a communications system can be rigged within the shell to allow a participant in the shell to communicate with at least one person outside of the shell. For example, a coach outside of the shell can communicate to a rider in the shell via the communication system. The communications system may be a wireless headset system, but may also be a speaker system. The speaker system could further be used to play audible noises (e.g., music). This may enhance the rider's experience.

Recall that at least one embodiment above described included the shell having transparent walls to permit the transmission of light and to further permit observes to view the rider and vice-versa. The transmission of light may cause the temperature within the shell to rise, especially on hot summer days. Ventilation throughout the shell can be provided to control the temperature in the shell. An airflow system can be provided to draw air in and/or remove air from the shell at predetermined rates, at selected temperatures, or both. The airflow system may include, without limitation, one or more fans, vents, cooling/heating elements, and the like.

Another enhancement for the gravity sports system is to provide a visual display, such as a projection of images, a display of lights within the shell, and the like. In one embodiment, lights are embedded in the wall of the shell. The lights can be selectively lit to trace the path of the rider, especially during night riding. Additionally or alternatively, the lights can be selectively lit to plot a course for the rider to follow, again adding another challenge and thus, another dimension of difficulty. In yet another embodiment, a projection of images, such as the projection of images in a planetarium, can be used to provide an illusory effect within the shell, for example of the illusion of gliding down a snowy slope or a street.

The gravity sports systems disclosed herein can be used at various locations. For example, the gravity sports systems can be installed on ships (e.g., cruise ships) or other transportation vehicles. The gravity sports systems can also be installed at private settings (e.g., casinos, hotels, amusement parks, and the like) and public settings (e.g., recreational areas). Other installation locations are also possible.

Some embodiments described herein create not only an entirely new spectator/competitive sport, but also create a recreational activity and a training means for participants in other gravity sports. For example, the spherical versions of the device could be operated for professional athletes to entertain fans and/or to compete against other athletes based on the level of their performances. Similarly, other shapes and axis orientation can be used to simulate skiing down a slope or riding a wave, thus creating enjoyment for experienced athletes and a training tool for less experienced athletes. A skilled artisan understands that the geometric terms used herein include both the perfect geometrical shape and approximations thereof based, for example, on manufacturing tolerances. For example, a spherical shell can be a perfectly spherical shell or a substantially spherical shell. The shape of the substantially spherical shell can be selected based on the desired manufacturing tolerances. Likewise, other terms, such as coincident, collinear, perpendicular, include both mathematical definitions and their definitions based upon understood manufacturing considerations.

In the above description, certain specific details are set forth in order to provide a thorough understanding of various disclosed embodiments. However, one of ordinary skill in the art will understand that the embodiments may be practiced without these details.

Unless the context requires otherwise, throughout the specification and claims which follow, the word "comprise" and variations thereof, such as "comprises" and "comprising" are to be construed in an open, inclusive sense, that is as "including but not limited to."

Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Any headings provided herein are for convenience only and do not interpret the scope or meaning of the claimed invention.

One reasonably skilled in the art will understand that particular features of the various embodiments may be combined with other embodiments to create new embodiments. These and other changes can be made to the invention in light of the above detailed description. In general, in the following claims, the terms used should not be construed to limit the invention to specific embodiments disclosed in the specification, but should be construed to include all mechanical, hydraulic, electro-mechanical, magnetic, and pneumatic actuation systems and methods of programmably controlling the movements of large shells that operate in accordance with the claims. Accordingly, the invention is not limited by the disclosure, but instead its scope is to be determined entirely by the following claims.

What is claimed is:

1. A system for exercising, comprising:

a rotatable shell having an inner riding surface and an enclosed chamber defined at least in part by the inner riding surface, the enclosed chamber being dimensioned to receive a user that rides equipment along the inner riding surface;

a frame that movably supports the shell such that the shell is rotatable about a first axis of rotation that extends through the shell;

a drive system adapted to cause rotation of the shell about the first axis of rotation independent of a user's movement in the chamber, the drive system is configured to rotate the shell at a sufficient speed to simulate traveling down a slope as the user rides non-motorized equipment that travels along the inner riding surface;

a controller communicatively coupled to the drive system, the controller is positioned outside of the rotatable shell and is inaccessible to the user riding the non-motorized equipment along the inner riding surface such that an operator positioned outside of the rotatable shell is capable of using the controller to command the drive system to adjust the rotational speed and orientation of the first axis of rotation, the controller including a first gravity sport program and a second gravity sport program, the controller being configured to selectively execute the first gravity sport program to command the drive system to rotate the shell about the first axis of rotation at a first speed to cause a first rider to travel along the inner riding surface towards a bottom of the shell such that the first rider is positioned at a first height to simulate traveling down a shallow hill, the controller being configured to selectively execute the second gravity sport program to command the drive system to rotate the shell about the first axis of rotation at a second speed to cause a second rider to travel along the inner riding surface towards the bottom of the shell such that the second rider is at a second height, the second height being greater than the first height; and a second axis of rotation about which the frame and the shell rotate and the second axis of rotation is spaced apart from the shell.

2. The system of claim 1, wherein the first axis of rotation is substantially perpendicular to the second axis of rotation.

3. The system of claim 1, further comprising: a third axis of rotation about which the frame and the shell rotate.

4. The system of claim 1, further comprising:

a tilting assembly including the frame, a shell actuator of the drive system coupled to the frame and the shell, and a frame actuator adapted to tilt the frame and the shell relative to a support surface on which the system for exercising rests while the shell actuator rotates the shell with respect to the frame.

5. The system of claim 1, wherein at least a portion of the shell is made of a substantially rigid, synthetic material.

6. The system of claim 1, wherein a curvature of at least a portion of the shell is parabolic.

7. The system of claim 1, wherein the shell has a spherical shape or a toroidal shape.

8. The system of claim 1, wherein the shell has a dimension between opposing points along the inner riding surface in a range of about 8 feet to about 40 feet.

9. The system of claim 1, further comprising:

a platform assembly for resting on a support surface, and the platform assembly movably supports the frame such that the frame and the shell are moved together about a second axis of rotation offset from the first axis of rotation.

10. The system of claim 9, wherein the platform assembly includes a wheeled transportation system and a cover for covering the transportation system, the drive system includes a frame actuator coupled to the transportation system, the frame actuator includes a motor and a plurality of rollers that engage and impart rotary motion to the frame when the motor is activated.

11. The system of claim 1, wherein the inner riding surface is a smooth surface that extends circumferentially about the chamber, and the chamber is a closed chamber.

12. The system of claim 1, wherein the drive system includes a pair of hub drive assemblies that define the first axis of rotation, the pair of hub drive assemblies are fixedly coupled to the frame such that the shell is interposed between the hub drive assemblies, and the hub drive assemblies include a motor that causes rotation of the shell about the first axis of rotation.

13. The system of claim 1, wherein a section of the inner riding surface defines a lateral side of the chamber with respect to the first axis of rotation.

14. The system of claim 1, wherein the inner riding surface comprises a peripheral section that extends radially about and longitudinally along the first axis of rotation.

15. The system of claim 14, wherein the peripheral section is a radially outermost section of the inner riding surface with respect to the first axis of rotation.

16. The system according to claim 1, further comprising: a plurality of intersecting structural beams coupled to an outer surface of the shell and the support frame.

17. The system according to claim 1, wherein at least a portion of the wall portion is substantially light transmissive.

18. The system according to claim 1, wherein the shell includes a plurality of geometrically shaped component segments joined together.

19. The system according to claim 1, further comprising: an upper dome removably attachable to the shell for allowing an upper portion of the shell to be open when the upper dome is removed.

20. The system according to claim 1, wherein the location for ingress and egress is sufficiently sized for access by a human being and their sports equipment ridable by the human being.

21. The system according to claim 1, wherein the controller is programmed to command the drive system to rotate the shell to position the first user along a substantially vertical section of the shell as the shell rotates.

22. The system according to claim 1, wherein the controller is programmed to cause the drive system to rotate the shell to keep the first user traveling along the inner riding surface in a direction towards the bottom of the shell as the shell rotates to simulate the first gravity sport.

23. The system of claim 1, wherein the first gravity sport program is executable by the controller to adjust a rotational speed of the shell, a direction of rotation of the shell, tilt of the shell, and elevation of the first user travelling along the inner riding surface independent of the first user's movement.

24. The system of claim 1, wherein the computing system is configured to control movement of the shell independent of the third rider's movement.

25. The system of claim 1, wherein the rotatable shell has a diameter of at least about 20 feet.

26. The system of claim 1, wherein the shell has a diameter of at least about 40 feet.

27. The system of claim 1, wherein the shell surrounds the rider and physically blocks the rider from accessing the controller.

* * * * *